United States Patent [19]

Paulson

[11] 4,365,830

[45] Dec. 28, 1982

[54] SAFETY LATCH FOR WASHER CLOSURE

[75] Inventor: Philip D. Paulson, Toronto, Canada

[73] Assignee: Inglis Limited, Mississauga, Canada

[21] Appl. No.: 157,465

[22] Filed: Jun. 9, 1980

[51] Int. Cl.[3] ..... E05C 19/06

[52] U.S. Cl. ..... 292/89

[58] Field of Search ..... 292/336.3, 175, DIG. 63, 292/DIG. 69, 149

[56] References Cited

U.S. PATENT DOCUMENTS

| | | | |
|---|---|---|---|
| 1,598,355 | 8/1926 | Maki | 292/175 X |
| 2,197,195 | 4/1940 | Schemers | 292/DIG. 63 |
| 2,431,178 | 11/1947 | Keane | 292/149 |
| 2,519,814 | 8/1950 | Bayless | 292/DIG. 69 |
| 3,088,623 | 5/1963 | Parker | 292/113 X |
| 3,627,960 | 12/1971 | Grobek | 292/DIG. 69 |
| 3,690,709 | 9/1972 | Bogusz | 292/259 X |
| 4,032,180 | 6/1977 | Pohl | 292/DIG. 69 |
| 4,074,545 | 2/1978 | Case | 292/DIG. 69 |

FOREIGN PATENT DOCUMENTS

| | | | |
|---|---|---|---|
| 1206121 | 9/1970 | United Kingdom | 292/175 |

*Primary Examiner*—Richard E. Moore

[57] ABSTRACT

An appliance for cleaning and treating clothes has a housing, a door and a closure for the door. The closure comprises means for impeding access to a handle portion for the door, a catch means for releasably securing the door shut and means for locking the catch means. The impediment means is manually movable to gain access to the handle where such movement releases the catch when unlocked. When the catch means is locked, movement of the impediment means to gain effective handle access is prevented.

19 Claims, 19 Drawing Figures

FIG.9.
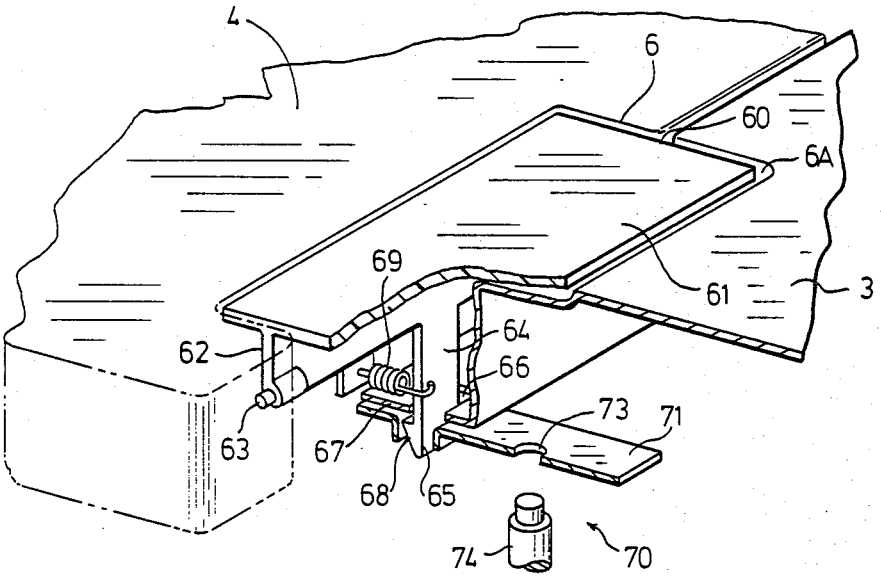
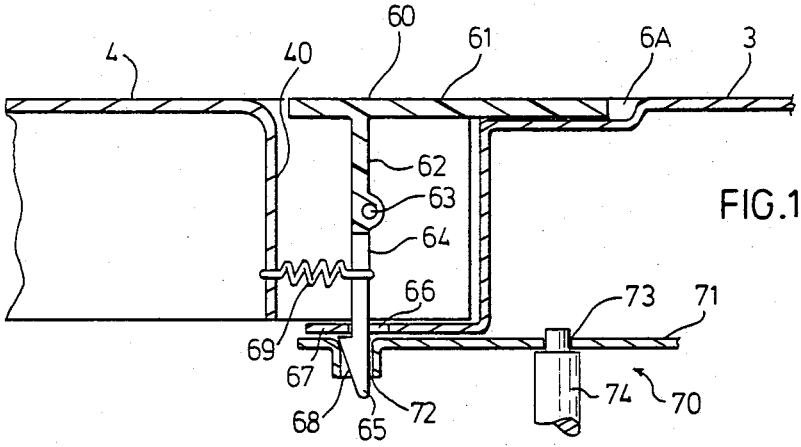
FIG.10.
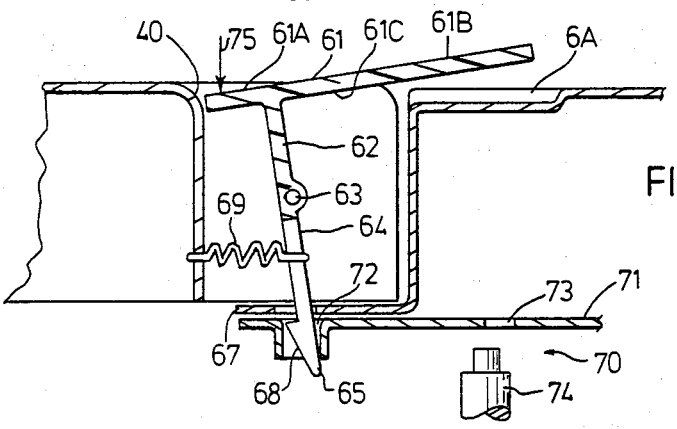
FIG.11.

FIG.12.
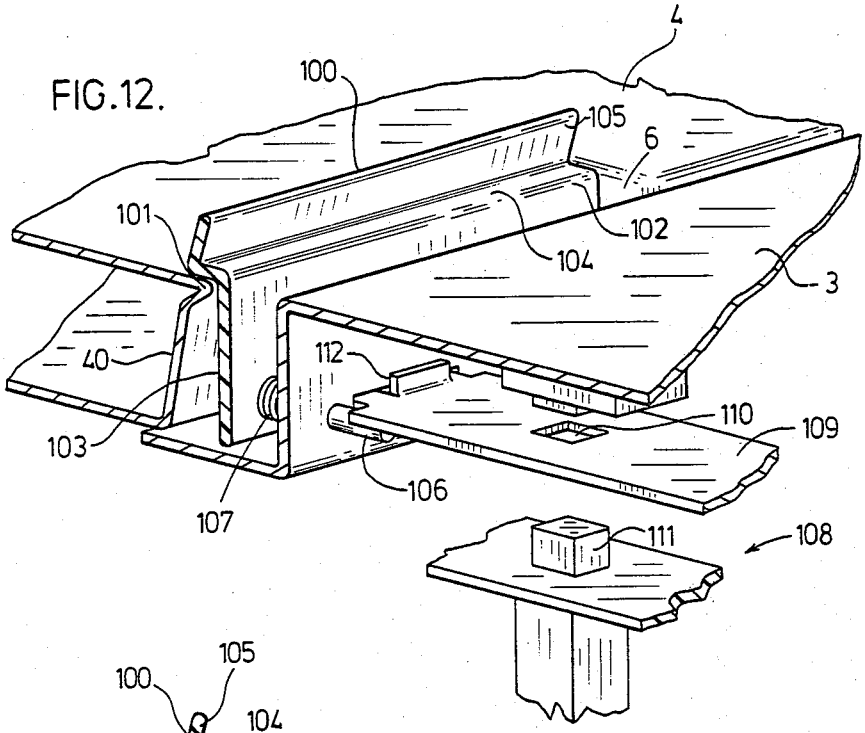
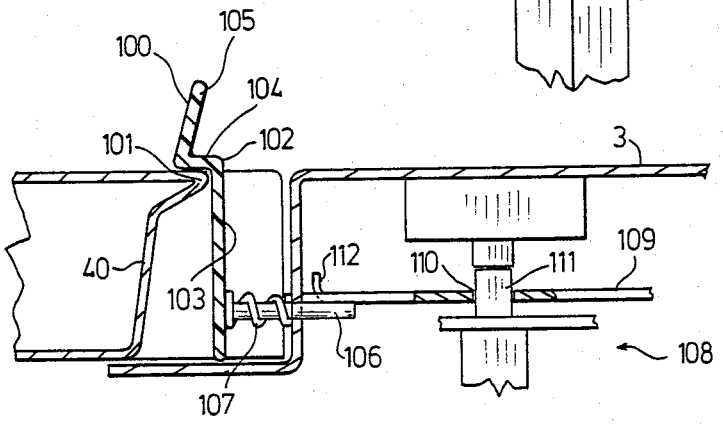
FIG.13.
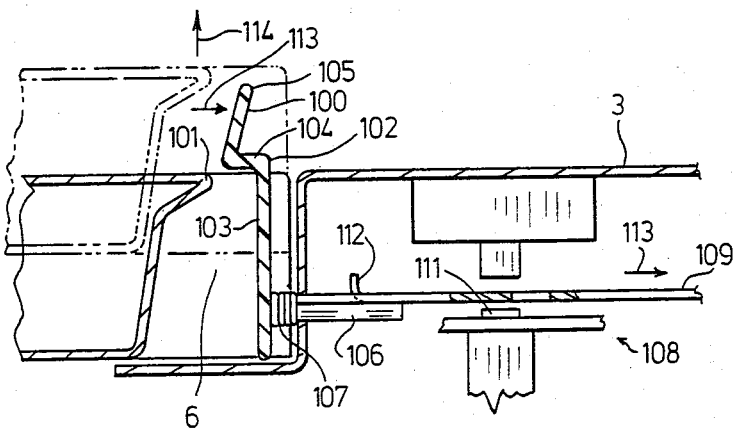
FIG.14.

SAFETY LATCH FOR WASHER CLOSURE

FIELD OF THE INVENTION

The present invention relates to a novel closure or latch for the door of an appliance for cleaning clothes.

BACKGROUND OF THE INVENTION

In automatic washing machines, it is usual to provide a handle on the outer surface of the door controlling access to the washing chamber or to provide a lip projecting into a recessed area along one edge of the door to act as a handle. Washing machines with this type of lid normally have a mechanical brake connected to the cleaning drum which is activated when the door is opened to quickly slow down the drum to allow safe access to the clothes. Recently safety features on clothes cleaning appliances have become a requirement in certain areas. In this regard, a lock has been provided on the door which is activated during the spin cycle. Thus, access to the spinning drum of the washing machine is prevented to avoid bodily injury. The lock is released upon completion of the spin cycle. The safety feature of this locking of the washing machine door has been further refined to prevent access within the washing machine until the drum has come to a complete rest, which may be effected by the mechanical brake. In order to accomplish this, in certain areas, it is now required that there be a time delayed release for the lock to ensure that the drum is at rest before the washing machine door can be opened.

SUMMARY OF THE INVENTION

The present invention is directed to providing a closure or latch for an appliance door which can be used with locking devices. The closure provides means which impedes or prevents access to the handle of the door until the impediment means is moved. Movement of the impediment means performs the function of allowing access to the handle and releasing a catch which latches the door closed. When used with a locking device, access to the handle for opening the door is prevented until a hazardous portion of a clothes cleaning or treating cycle is ended. The handle can only be employed as such when the catch is unlocked and the impediment means is free to move and permit access to the handle.

According to an aspect of the invention, a closure is provided for a door on an appliance for cleaning and treating clothes. The closure comprises means for impeding access to a handle portion for the door, a catch means for releasably securing the door shut and means for locking the catch means. The impediment means is manually movable to gain access to the handle where such movement releases the catch when unlocked. The arrangement is such that, when the catch means is locked, movement of the impediment means to gain effective handle access is prevented.

Another aspect of the invention provides an appliance for cleaning clothes having a housing and a door hingedly secured to the housing. The door provides access to a cleaning chamber located in the housing and has an indentation on one side to define a recess. A closure is provided for the door and comprises a catch and impediment means such as a barrier. The catch is adapted to latch the door closed. The barrier is mounted within the recess and is adapted to be movable within the recess. The movement of the barrier is such that the catch is released from a position where it is engaged to latch the door. The movement of the barrier also provides access to a handle for the door. When the catch is engaged by a locking means to keep the door closed, the barrier impedes access to the handle.

A further aspect of the present invention provides for the impediment means to be movably mounted on the door for impeding access to the door handle. The impediment means is manually movable in direction which places an operator's fingers beneath the handle portion in gaining handle access to facililate one-handed opening of the door.

DESCRIPTION OF THE DRAWINGS

Preferred embodiments of the invention are shown in the drawings wherein:

FIG. 9 is a perspective view partly in section of a further embodiment of the invention;

FIG. 10 is a plan view of the embodiment illustrated in FIG. 9;

FIG. 11 shows the view of FIG. 10 with the door closed and the latch released;

FIG. 12 is a perspective view partly in section of a further embodiment of the invention;

FIG. 13 is a plan view of the embodiment illustrated in FIG. 12;

FIG. 14 shows the view of FIG. 13 with door closed, and in dotted lines open and the latch released;

DETAILED DESCRIPTION OF THE PREFERRED EMBODIMENTS

Figure 1:
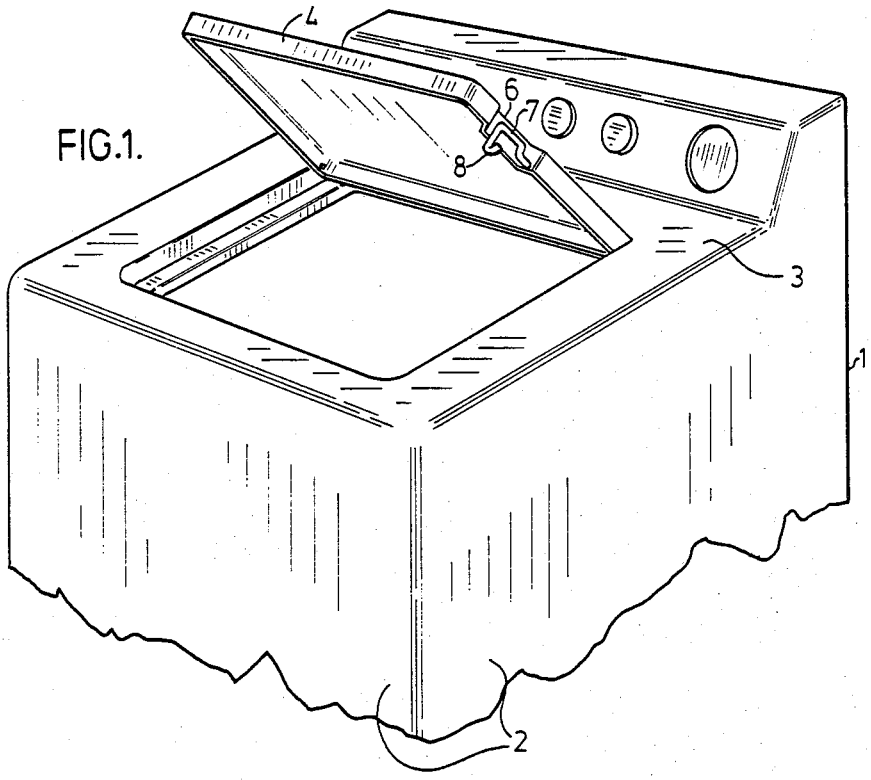
FIG. 1 is a perspective view of the top of a clothes cleaning appliance equipped with an embodiment of the present invention.
Figure 2:
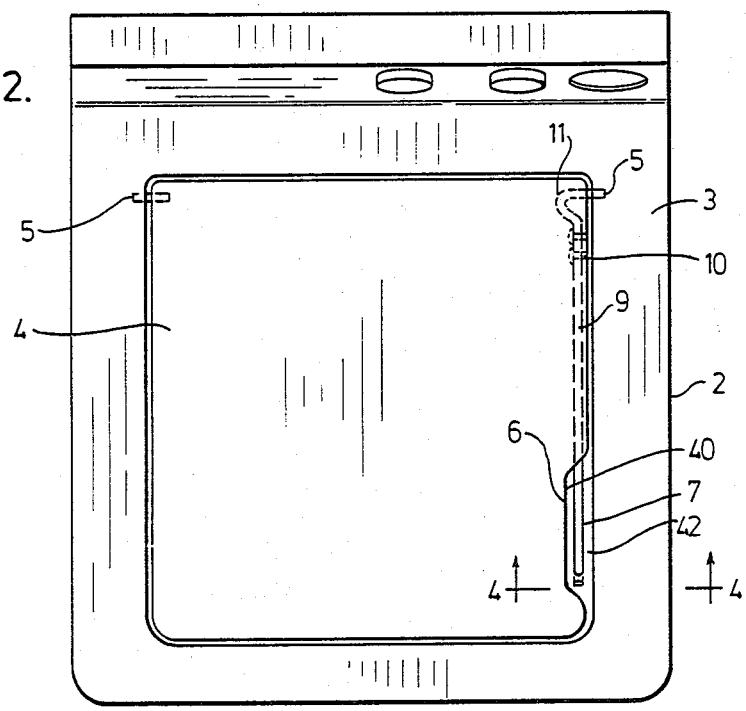
FIG. 2 is a top plan view of the clothes cleaning appliance illustrated in FIG. 1.

In FIGS. 1 and 2 an automatic clothes washing machine is illustrated having a housing 1, the housing having side walls 2 and top surface 3. A door 4, located over the machine opening, is hingedly secured to the top of the housing 1 by hinges 5. A recess generally indicated at 6 is provided in the edge of one side of the door, the recess being defined by the edge of the door 40 and the adjacent edge of the top surface 3 of the housing 1. A latch according to one embodiment of the invention is provided for the door. The latch comprises a handle portion 7 effectively provided on the underside of the rod. The handle is located in the recess 6 in the edge of the door and a catch 8 is depending from one end of the handle. In FIG. 2, the dotted lines indicate that the latch further comprises a portion 9 which is secured to the door by screws, bolts or rivets indicated at 10 thereby providing a means mounting the handle to the door. The latch is further provided with a curved portion 11 which is adapted to form one of the hinges 5 for the door. In the embodiment illustrated, the latch is a formed metal rod; however, it could be of any material such as plastic which would have the necessary strength and rigidity to act as a handle and catch for the door.

Figure 3:
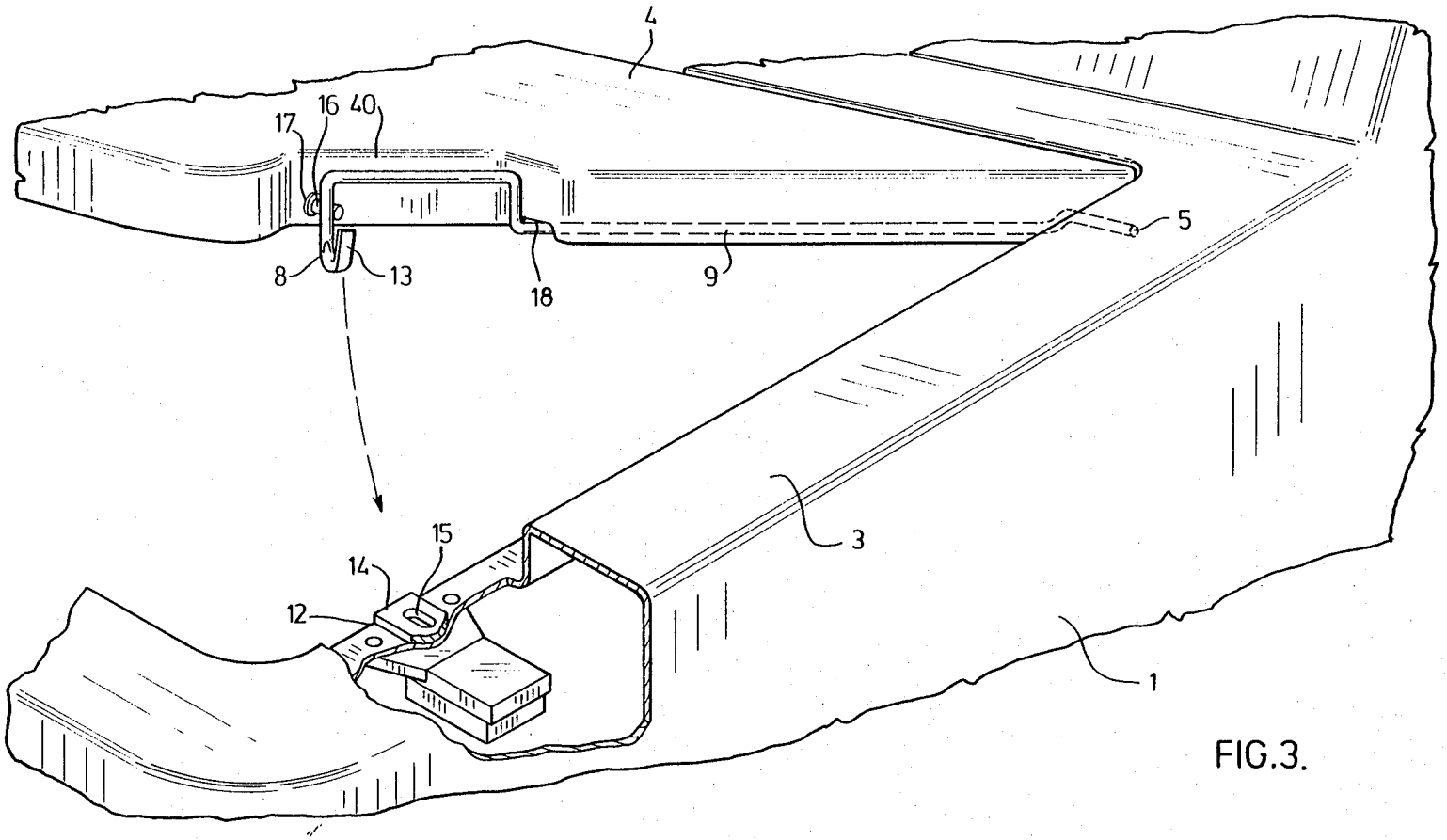
FIG. 3 is a perspective view partly in section of the embodiment shown in FIG. 1.

In FIG. 3, a section has been removed from the housing 1 to show a locking means 12 located therein. The catch portion of the latch 8 has one end 13 hook-shaped and adapted to be secured under or by the locking means 12. The locking means illustrated is provided with selvedge 14 having an aperture 15 located therein. The catch 8, when the door is closed, projects through the aperture 15 and the hook end 13 is positioned under the lower surface 21 of the selvedge 14. From FIG. 3, it can be seen that the latch is further provided with a metal rod 16 welded to the handle portion and projecting into the edge of the door 40. This rod 16 acts as a guide and support means for the lateral movement of the handle 7. This lateral movement of the handle 7 disengages the catch 8 from the locking means 12. The guide means 16, in this embodiment, projects into a bushing 17 mounted in the edge of the door 40 so as to allow easy movement in and out of the door. It can also be seen in FIG. 2 and FIG. 3 that the door is provided with a slight cut out portion 18 along the bottom surface where the rod projects into the recess 6 and forms handle 7 to allow the handle room to move laterally.

In FIG. 2, it can be seen that access to the underside of the rod to get at the handle 7, when the door 4 is closed, is limited from either side as the space 42 between the handle 7 and the adjacent edge of the top surface 3 of the housing 1 is not sufficient to allow a hand to get at the handle 7 to lift the door unless the rod is moved towards the edge of the door 40, so as to disengage the catch 8. Thus, the upper portion of the rod acts as a barrier or impediment means relative to the housing and door side to prevent effective access to the handle. If the catch 8 is locked in position, the handle 7 cannot be moved laterally a sufficient distance from the edge of the top surface 3 of the housing 1 to allow a hand to grip the handle 7, thereby preventing the handle 7 from acting as a handle until the catch 8 is unlocked.

Figure 4:
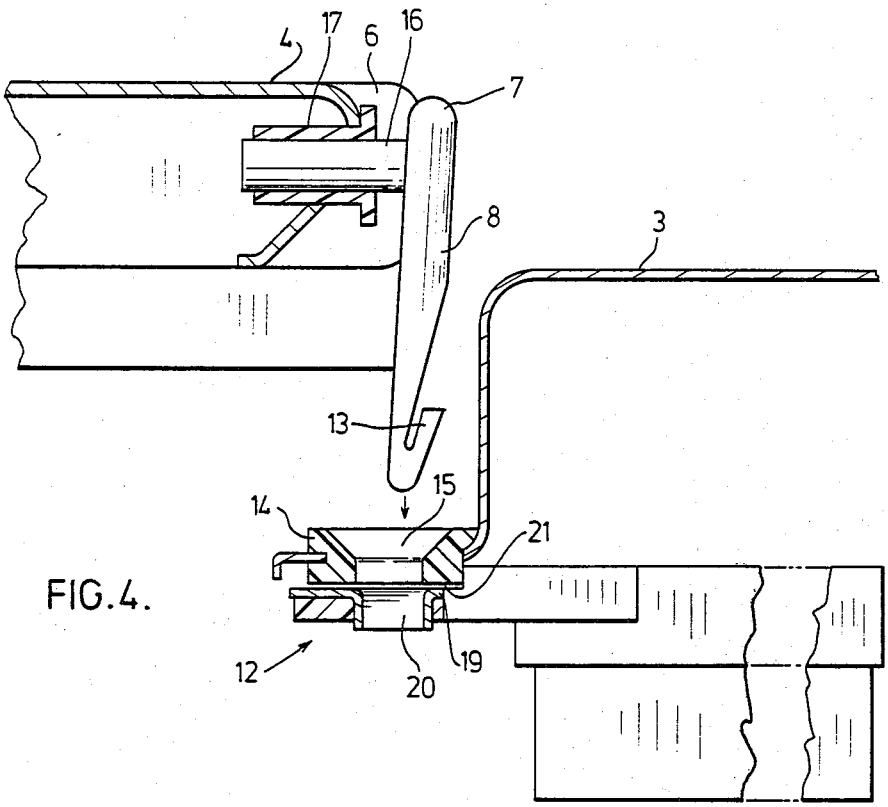
FIG. 4 is a view taken along the lines 4—4 of FIG. 2 where the lid is slightly open.

In FIG. 4, the catch 8 is illustrated in the unengaged position relative to locking means 12. As the door 4 is closed, the catch 8 by the leading edge of the hook 13 is guided into the aperture 15 in the selvedge 14 of the locking means 12. The locking means is provided with a sliding plate 19 having an aperture 20 therein which is presently aligned with aperture 15 in the selvedge 14.

Figure 5:
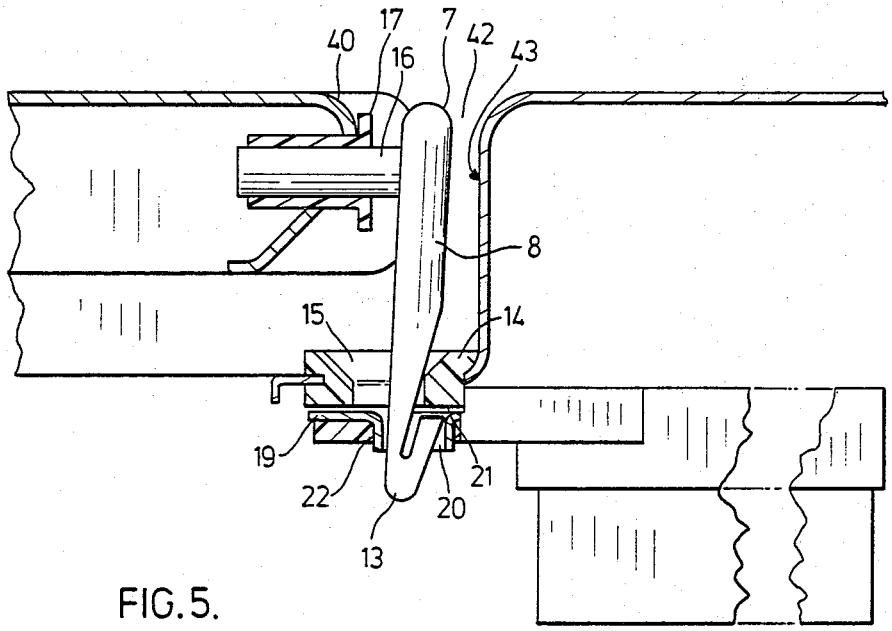
FIG. 5 shows the view of FIG. 4 with the lid closed and the catch operatively engaged with the locking means.

As the catch 8 is guided into the aperture 15 and the aperture 20 in the sliding plate 19, the plate is forced sideways until the hook 13 springs under the lower surface 21 of the selvedge 14. The sliding plate 19 does not deter the action of the catch 13 to be grasped under the bottom edge 21 of the selvedge 14 as it is adapted to move freely sideways unless the catch 8 is desired to be locked in position. The handle 7 is adapted so as to be biased towards the housing 1 where the catch 8 will be engaged. The biased mounting ensures that the end 13 of the catch 8 will be positioned under the lower surface 21 of the selvedge 14. It can be further seen in FIG. 5 that, when the catch end 13 is engaged under the lower surface 21 of the selvedge 14 that the sliding plate 19 has been displaced laterally. If the catch 8 is desired to be locked in position, the plate 19 is locked so that it cannot be moved. The handle 7 then cannot be moved a sufficient distance to allow the catch end 13 to be released from the lower surface 21 of the selvedge 14, because it encounters the far side 22 of the aperture 20 in the sliding plate 19. The plate 19, because it is locked in position, is not free to move sideways; therefore, preventing the door from being opened and precluding access to the handle 7. If it is not desired to lock the door in position, the sliding plate 19 is not locked and the lateral movement of the handle and corresponding movement of the catch 8 would displace the plate 19 as the catch 8 encountered the side 22 of the aperture 20 in the plate 19, allowing the catch 8 with the hook 13 to be disengaged from the lower surface 21 of the selvedge 14.

Figure 6:
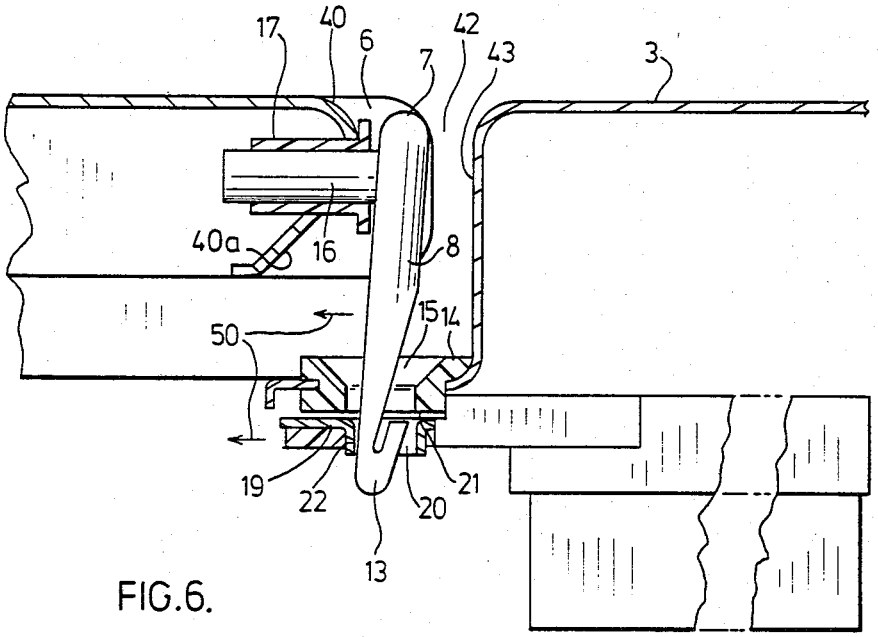
FIG. 6 shows the view of FIG. 4 with the lid closed and the latch released.

In FIG. 6, the catch 8 is illustrated as it is being disengaged. Arrows 50 indicate that the handle 7 has been moved laterally. The end of the catch 13 is now clear of the lower surface 21 of the selvedge 14 and the door is free to open. The plate 19 has been displaced in the direction of movement of the handle 7 as indicated by arrows 50. The guide means, rod 16, has also moved sideways within bushing 17. The space 42 defined by the rod and the adjacent edge 43 of the top surface 3 of the housing 1 is sufficient to allow a hand to grasp the rod underside; namely handle 7 to allow the user to lift the door 4. The edge of the door 40 is bevelled at the bottom **40*a* to provide a further handle portion under which the fingers can grip to aid in opening the door. Where this bevelled section 40*a* is employed as the only functioning handle, then the rod portion may be considered as a barrier preventing access to handle portion 40*a***. Actuation of the locking device may be accomplished in many ways. In instances where the door is used on a washing machine and is desired to bar access to within the machine during the spin cycle, the actuation of the locking device may be accomplished electrically through a solenoid, as tied in with the timer for the washing machine cycles. Thus, when the timer moves into the spin cycle phase, an electrical solenoid for the locking device is actuated to lock the catch in position and thereby prevent access to the handle. As soon as the spin cycle phase of the timer has been completed, power to the electrical solenoid of the lock is cut off to thereby release the catch and permit door opening. In this instance, when the spin cycle is completed, or if there is a power failure the brake requires a finite time to bring the drum to rest. Thus, it is desirous to prevent access to the washing machine drum after the spin cycle is completed and the drum has been braked to a stop. This can be accomplished by time delay release for the locking means.

Figures 7, 8:
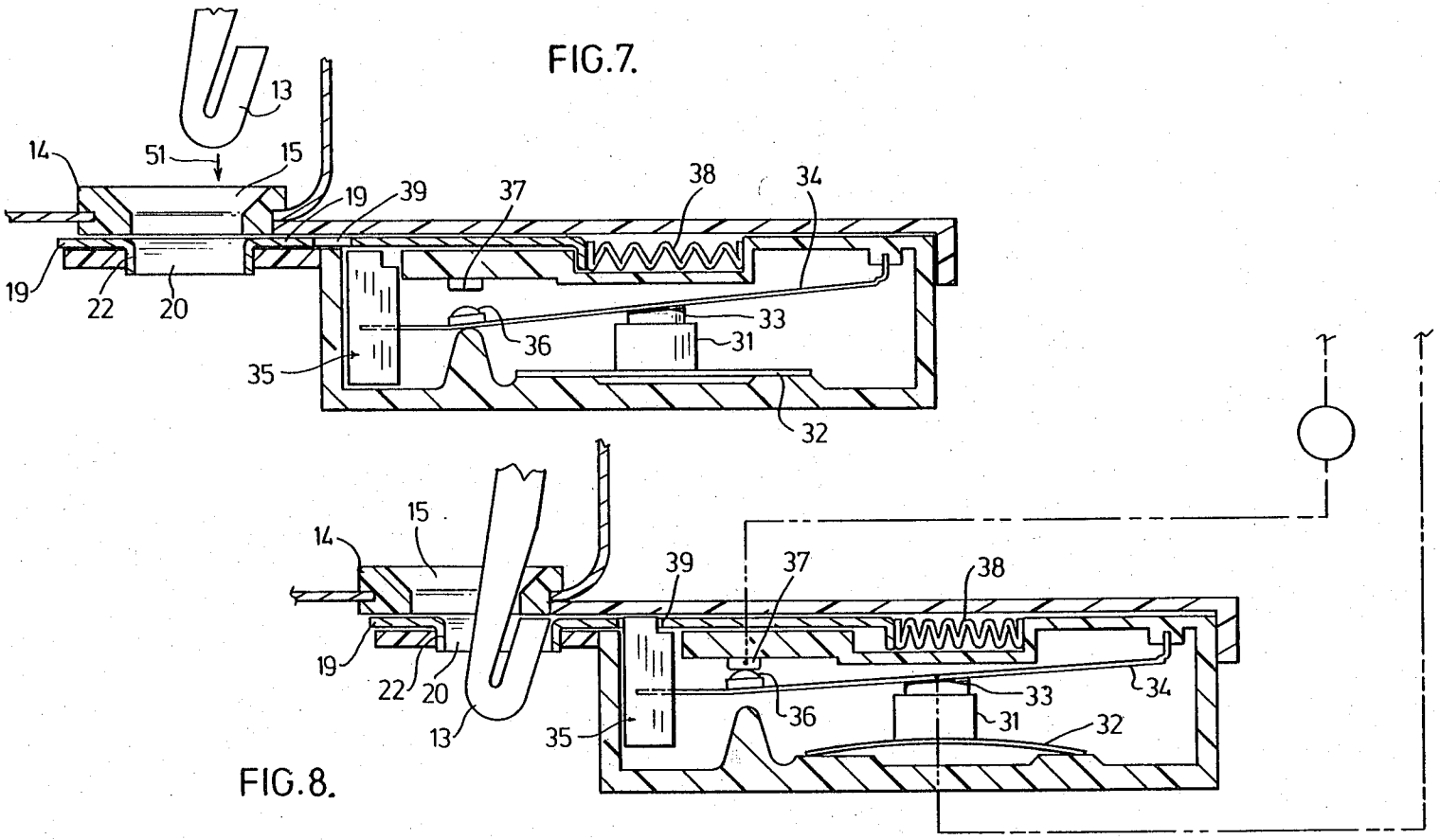
FIG. 7 is a plan view of a time delay release locking device which can be used with this embodiment of the invention.
FIG. 8 is a further plan view of the time delay release locking means of FIG. 7 wherein the catch portion of the invention is locked in place.

In FIGS. 7 and 8, an example of a time delay release for the locking means, which can be used with this invention, is illustrated. A timer located on the machine when the spin cycle is ready to begin, closes a switch that passes an electrical current through a ceramic block 31. The ceramic block heats up causing two bimetallic plates 32 and 33 disposed on opposite sides of the block 31 to bend in opposite directions. This causes an arm 34 connected to plate 33 to rise. On the end of the arm 34 is a pawl 35 which is adapted to fit into a second aperture 39 in the sliding plate 19. As the arm 34 rises a contact point located at 36 connects with another point 37, thereby connecting the circuit to the spin solenoid.

The activated spin solenoid engages the drive in a manner to begin spin cycle of a drum in the washing process. With the door closed in position, the second aperture 39 in the sliding plate 19 is positioned so that the pawl 35 fits within it thereby locking the plate 19 in position and not giving the catch 8 and the hook 13 thereof sufficient room in which to move laterally so as to disengage the hook 13 from the bottom surface 21 of the selvedge 14. The plate 19 is provided with a spring 38 at its end remote from the selvedge 41 so that the plate 19, after the catch 8 is disengaged, is returned to a position whereby aperture 20 in the plate 19 is lined up with the aperture 15 in the selvedge 14. This allows the hook end 13 of catch 8 to be inserted in aperture 20 in plate 19 without difficulty, when the door 4 is closed again. When the timer determines that the spin cycle is complete a switch is opened in the circuit thereby cutting off the current to the block 31. The current is also shut off to the spin solenoid and the drum is no longer driven and begins to stop spinning. A mechanical brake may be supplied to aid in stopping the spinning of the drum after the drum is no longer driven. With the current no longer flowing through the block 31, the thermal energy in the block 31 dissipates causing the bimetallic plates 32 and 33 to return to the unflexed position causing the arm 34 and the pawl 35 to drop thereby allowing the handle 7, when it is moved laterally, to move the plate 19 sideways thereby disengaging the catch 8 and the hook 13 from under the bottom surface 31 of the selvedge 14.

The time delay release feature for the locking device ensures that the door remains closed for a sufficient period of time after the circuit to the spin solenoid is disconnected to allow the drum time to have stopped spinning completely before the door can be opened. The materials for block 31 and plates 32 and 34 are, therefore, selected to dissipate thermal energy at a predetermined rate so as to ensure that pin 39 keeps the door locked for a sufficient period of time. The time delay release of the type described above or any other similar time release mechanism, such as time delay locks based on hydraulic or pneumatic delay, used with the embodiment of this invention as described above, provides a safe and efficient means in which to lock the door of a clothes washing appliance during the operation of the spin cycle. The latch formed as in the embodiment provides an easy to install, economical to produce and easy to operate combination catch, barrier and handle which will fit with any standard door of a washing machine having a recess located therein without the need of substantial additional tooling.

In FIGS. 9, 10 and 11, a second embodiment of the invention is illustrated. In the recess 6 of the door 4 of a washing machine is a closure generally indicated at 60. The closure 60 has a generally T-shaped cross-section with the hat or plate portion 61 of the T substantially coplanar with the top surface of the door 4 and the adjacent housing top surface 3. The hat 61 of the T is adapted so that it fits within an indentation **6*a* in the top surface 3 of the housing. The stem 62 of the T is pivotally mounted at its base to the door 4 by a pin 63. Any other convenient means can be employed to pivotally mount the closure device 60 within the recess 6 of the door 4**.

A catch portion 64 integral with stem 62 depends from the base of the plate into the housing. The end 65 of the catch 64 projects into the housing through an aperture 66 located therein and is adapted to be latched under the surface of the housing 67 defining the aperture 66. In the embodiment illustrated, the end 65 is shaped to form a barb with the end tapered along edge 68 to provide a guiding surface to allow easy movement of the catch 64 in and out of the aperture 66. A spring 69 is connected from the edge of the door 40 to the catch 64. The spring 69 or any other type of spring means functions to keep the catch 64 biased towards the position where the barb is under the surface of the housing 67 defining the aperture 66. This position is illustrated in FIG. 10.

A locking means generally indicated at 70 is located within the housing and is adapted to lock the catch 64 in the engaged position as illustrated in FIG. 10. The locking means is provided with a sliding plate 71 having an aperture 72 located therein. This aperture 72 is aligned with aperture 66 in the housing. The spring 69 causes the catch 64 to be pulled towards the door so that the end of the catch 65 will be engaged under the surface of the housing 67. The sliding plate 71 is adapted so that it is easily displaced to allow the end of the catch 65 to be operatively engaged. A second aperture 73 is provided in the sliding plate and is positioned so that, when the catch 65 is in the engaged position, a pawl 74 can project up into the aperture 73 thereby locking the sliding plate 71 in position. This is illustrated in FIG. 10. The first aperture 72 in the sliding plate 71 is sized so that insufficient space is provided when the plate is locked in position to allow the end of the catch 65 from being disengaged from under the surface of the housing 67 and allowing the door 4 to be opened. Various locking mechanisms, as described earlier, which may include the time delay release feature, can be installed to control the movement of the pawl so that the door is locked at the desired times.

The closure illustrated in FIGS. 9, 10 and 11 is further described with reference to its mode of operation. The opening of the latch closure is illustrated in FIG. 11. The arrow 75 indicates that a downward force is applied to the part **61*a* of the hat of the T nearest the edge of the door 40. The plate 60 pivots or rocks about pin 63 and a similar pin located at the other end of the closure. The downward movement of the first part 61*a* of the closure causes the second part 61*b* located adjacent the top surface of the housing 3 to be lifted above the plane defined by the door 4 and the top surface of the housing 3. The length of this second part 61*b* of the plate is sized relative to the first part 61*a* to allow the second part 61*b* to be raised a sufficient distance above the housing 3 to allow a hand to grip the underside 61*c* of the plate. Therefore, the handle for the door is constituted by the underside 61*c*** of the closure device.

The end of the catch 65 has also been displaced so that it is disengaged from under the surface of the housing 67. In being disengaged, it has displaced the sliding plate 71 to allow the end of the catch 65 to be removed from within the housing and allow the door 4 to open. If the plate 71 is locked in position as illustrated in FIG. 10, the catch will not be allowed to move, thereby preventing depression of the part **61*a* of the closure. The second part 61*b* of the handle will not be raised a sufficient distance above housing 3** so that the underside 61*c* of the plate can be gripped by a hand. As a result, access to the handle 61*c* of the closure is impeded or precluded due to the plate 61*b* being proximate the housing 3.

The latch can be formed from a tough thermoplastic or other material that is rigid and strong enough to withstand the abuse of day-to-day operation.

A third embodiment of the invention is illustrated in FIGS. 12, 13 and 14. A closure indicated generally at 100 is provided within the recess 6 of the door 4. The door 4 is equipped with a lip 101 along the edge of the door 40 within the recess 6 and the lip 101 functions as the handle for the door 4.

A barrier 102 prevents access to the lip 101. The barrier has a vertical section 103, a short horizontal section 104 adapted to snap over the lip 101 when the door 4 is closed and a second generally vertical section 105. This second section 105 is slanted away from the door 4 to allow the lip 101, as the door is being closed, to cam the barrier 102 sideways allowing the door to be closed. After the door is closed, the horizontal section 104 acts as a catch to be engaged over the lip 101 preventing access to the handle for the door unless the barrier 102 is moved.

A rod 106 is connected to the barrier 102 and projects into the housing. A spring 107 is provided around the rod 106 and biases the barrier 102 towards the position whereby the horizontal section 104 would be engaged over the lip 101 of the door 104. This position is illustrated in FIG. 13.

A locking means generally indicated at 108 is located within the housing. A sliding plate 109 is connected to the rod 106. An aperture 110 is located in the plate 109 through which a pawl 111 can project to lock the plate 109 in position. A projection 112 on the plate 109 limits the distance the plate 109 can move ensuring the barrier 102 is in a position so that, when the door is opened, the lip 101 can meet the second vertical section 105 at a point where the lip 101 is able to displace the barrier 102 as the door is closed. A mechanism, as described above, can be provided to control the pawl 111 so that the door is locked at the desired times.

The operation of the closure is illustrated in FIG. 14. Arrows 113 indicate that the barrier 102 is displaced and kept displaced a sufficient distance to disengage the horizontal section 104 from the top of lip 101 and to allow sufficient space between the lip 101 and the barrier 102 to allow a hand of the operator to grip under the lip 101 to open the door. Arrow 114 and the door represented to dotted lines indicate that the door is opening. After the door is open, the barrier 102 returns, due to spring 107 to a position determined by stop 112. This position is such that in 111 will not line up with aperture 110. Pin 111 may be designed such that it only closes a switch to permit activation of the spin cycle when it extends through aperture 110 of the sliding plate 109. Therefore, activation of the spin cycle can only occur when the door is closed, so that the catch has aligned aperture 110 with the pin 111. The barrier 102 can be formed of any material having sufficient rigidity and strength to withstand the abuse of day-to-day operation such as a tough thermoplastic or metal.

Figure 15:
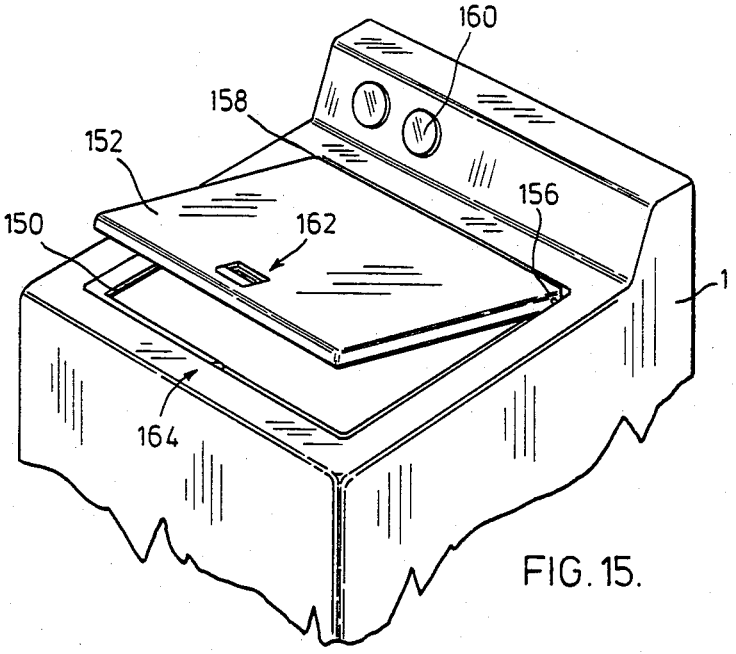
FIG. 15 is a perspective view of the top of a clothes cleaning appliance equipped with another embodiment of the present invention.

A further embodiment of the invention is illustrated in FIGS. 15 through 19. The automatic clothes washing machine, as shown in FIG. 15, is the same as that in FIG. 1 having a housing 1 with top loading opening 150 and a door hingedly secured to the housing at its rear portion at points 156 and 158. Such hinge securement at these points may be by way of pins 5 of the type shown in FIG. 1. The timer for the washing machine cycles is generally designed 160. Along the front portion of the door 152 is located the closure 162 which is engagable by a locking means 164 in the housing. With this particular embodiment, facility is made for providing a door surface which is essentially flush with the upper surface of the housing 1. This flush top concept is useful for compact washing machines, where it is desired to form a portion of a countertop by use of the washing machine top.

Figure 16:
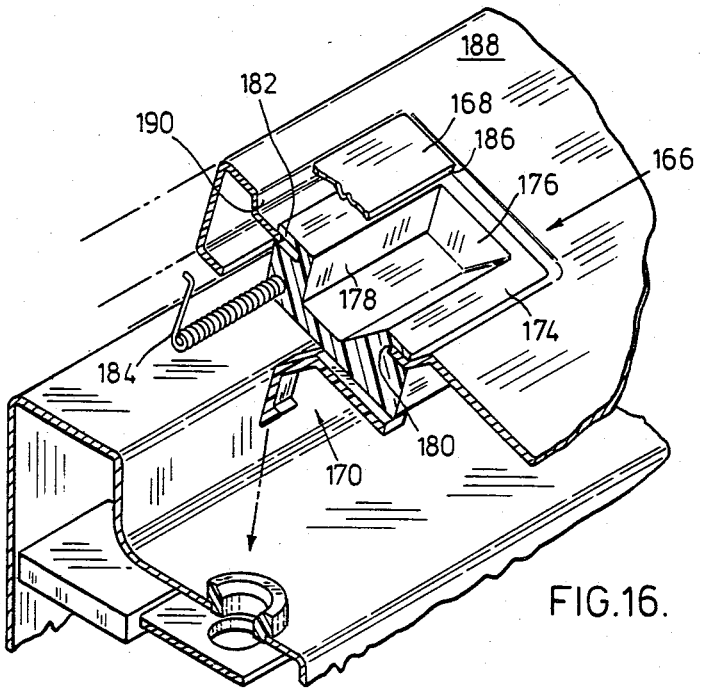
FIG. 16 is a cut-away section showing an enlarged view of the closure of FIG. 15 for the door.

The closure, as shown in more detail in FIG. 16, comprises means 166 for impeding access to a handle portion 169 and a catch 170 for engagement with a locking means 172. The impediment device 166 is manually movable to gain access to the handle 168 for opening the door. With such movement, the catch is simultaneously released when unlocked. Should the catch be locked, movement of the impediment device 166 is prevented to preclude effective access to the handle 168.

The means for impeding access to the handle 168 has, according to this embodiment, a body portion 174 wherein a finger gripping recess 176 is formed with a forward wall 178. When the latch 170 is locked by device 172, the wall 178 impedes effective access to the handle 168 for opening the door. Thus, during desired times the door cannot be opened.

The body portion 174 is adapted for sliding movement in an opening defined by door edges 180. Grooves 182 are provided along the body portion 174 which receive door edges 180 to permit this sliding movement. A spring device 184 is mounted in the block 174 and is associated with the door so as to resiliently urge the body portion towards the position shown in FIG. 16. In this position, the wall portion 178 is aligned with the edge 186 of the door handle. Although not shown, various techniques may be employed for mounting the door portion 174 in the opening of the door, such as modifying the front or rear edge of the body portion to provide for a snap fitting therein as the grooves are located in the door edges 180. Reference may be made to U.S. Pat. No. 3,841,674 for further details on a particular form for snap fitting devices in door openings.

The handle portion 168 is planar with the upper surface 188 of the door to provide a flush top mounting. As a result, the opening for the barrier 166 is provided in a depression 190 formed in the door top. This permits the barrier to move beneath the handle in gaining access thereto.

Figure 17:
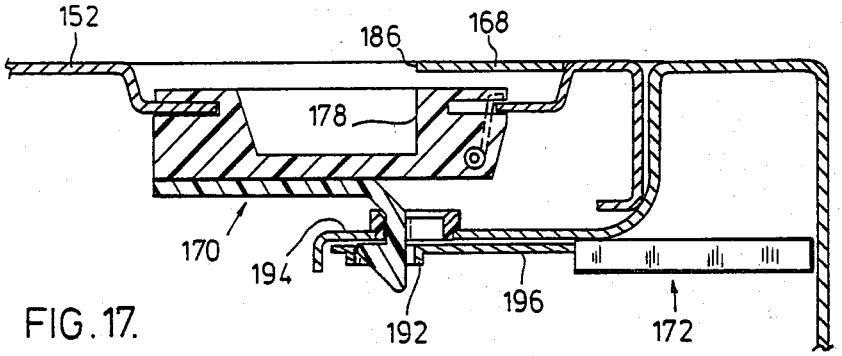
FIGS. 17, 18 and 19 are further cross-sections of the closure of FIG. 16 showing various positions of the closure in the one-handed opening of the door.
Figure 18:
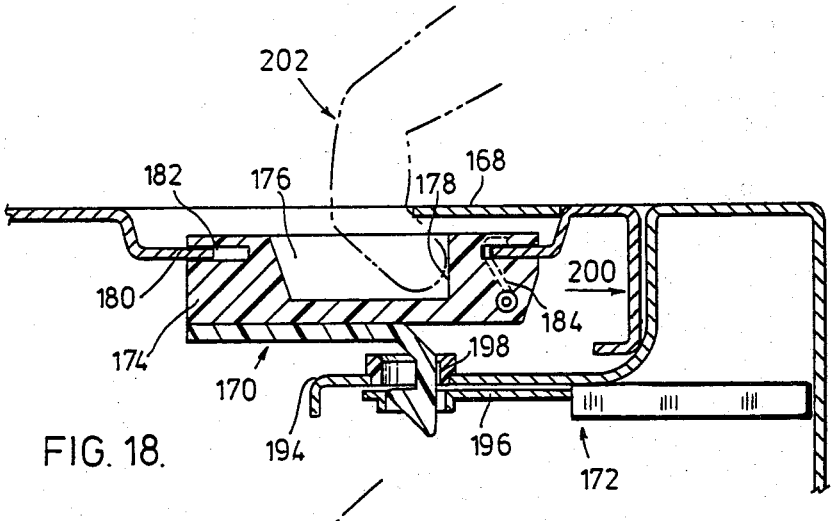

As shown in FIG. 17, with the door 152 closed and the catch 170 locked by locking device 172, the wall portion 178 of the finger recess is aligned with the edge 186 of the handle portion 168. Due to the locking of the catch 170, although it is free to move slightly under the handle 168 to the extent determined by edge 192 of the apertures of the locking device, this does not permit access to the handle portion 168 to exert any effective pressure on the catch 170 which remains secured beneath the selvedge plate 194.

As previously described, the actuation of the locking device 172 may be accomplished in several ways and, for example, can be determined by the timer 160 to actuate a solenoid having a stop pin for insertion in an opening of slidable plate 196 to lock the plate in the position shown in FIG. 17.

At the completion of a machine cycle when it is permissible to open the door, the locking device 172 may be released. This permits movement of the plate 196 to allow the catch 170 to clear the aperture 198 in the selvedge plate 194. In this particular embodiment, the catch 170 is secured to the body portion 174 of the barrier, so that by manually moving the barrier 174 in the direction of arrow 200, effective access is gained to the handle 168 against the bias of the spring 184.

Figure 19:
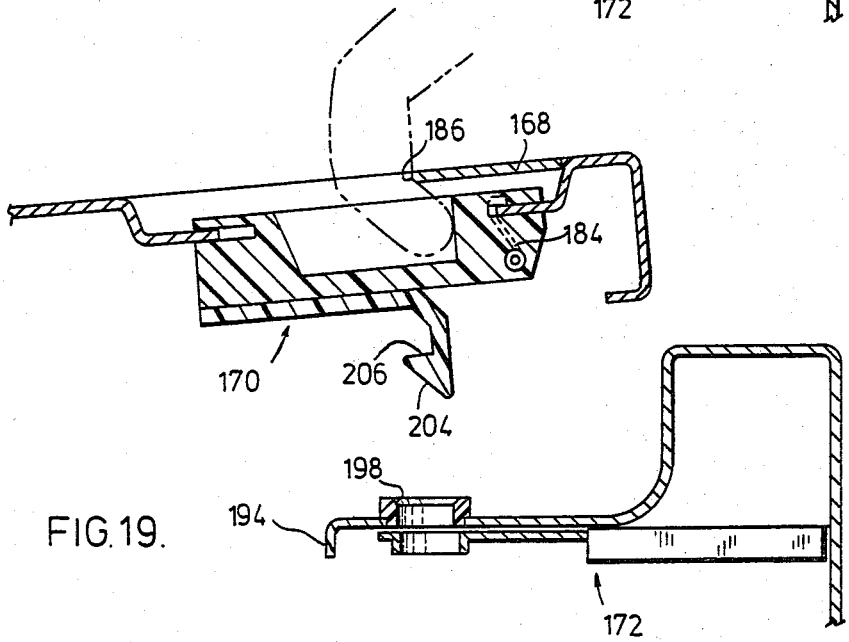

This embodiment, therefore, provides a one-hand opening of the door as demonstrated in FIG. 19 by fingers 202 being inserted in the finger recess 176 to move the wall 178 away from the entrance of and beneath the handle 168. In locating the closure 162 at the front of the door, the manual movement of the barrier 166 in a direction which releases the catch, automatically places the fingers beneath the handle 168. In the operator drawing his hand towards himself, there is the natural tendency to keep the fingers beneath the handle to facilitate one-handed opening of the lid, because an inward pulling force is being exerted on the edge 186 of the door handle 169.

When the handle is released, the spring 184 returns the catch 170 to the position shown in FIG. 17 relative to the door 152. As a result, when it is time to close the door, the sloped edge 204 of the catch cams against the opening 198 of the selvedge plate 194 to snap the locking edge 206 beneath the plate 194 to achieve the position shown in FIG. 17 relative to the locking device 172.

Although the handle 168 is shown as a separate component secured to the door, it is appreciated that the depression formed in the lid may be such that a portion is cut away to provide access to lid underside and thereby form the handle 168 integrally with the lid in providing a flush top counter for the washing machine. The relationship of the sliding barrier 166 relative to the opening is such to always cover the opening as the grooves 182 in the block slide over the edges 180 of the opening in the door.

The catch 170 has been shown as being secured to the body portion 174 of the impediment device 166. Thus, the catch 170 may be made from material dissimilar from the body portion 174 to suit the functional purposes of the catch as compared to the functional purposes of the body portion 174. For example, the catch may be formed of a stronger material which may be hard plastic or metal, whereas the body portion 174 of the barrier may be formed from a less expensive plastic material or the like. In other applications, it may be permissible to integrally mold the catch 170 with the body portion 174 where an appropriate material can be used for the relative economic manufacture of the closure.

It is also appreciated that the catch need not be secured directly to the barrier 166 as long as their arrangement is such that, when the catch is unlocked, movement of the barrier releases the catch to permit door opening. Also, the association between catch and barrier must be such that when the catch is locked the barrier cannot be moved to an extent which would permit effective access to the handle 168 in attempting to pry the door open. Such association between catch and barrier may be accomplished by slide and stop arrangements or other forms which would be apparent to those skilled in the art.

The various described types of closure or latch, according to this invention, may be used on several types of clothes cleaning devices, such as top and front loading washing machines, clothes dryers and clothes cleaning devices. The lock which secures the catch of the latch may be actuated and remain actuated during portions of the cycle which could bring about bodily injury or result in spills should the door be opened. For example, with a front loading washing machine, it is important to ensure that the door cannot be opened until substantially all water has been drained from the basket or is below the level of the door. During the spin cycle of an automatic washer, it is important to ensure that no access is gained to the spinnable drum and preferably not until after the brake mechanism has brought the drum to rest on completion of the spin cycle. A further consideration could be that this system be designed to eliminate the need for a brake mechanism on an automatic washer. It is understood that the drum, on completion of the spin cycle would eventually stop spinnng if not braked. This period of spin stoppage in absence of braking may be approximately 1 to 2 minutes. Therefore, the timed delay on latch release would be slightly greater than the anticipated period for the spinning basket to come to a rest. As a result, access to the basket would not be permitted until it had come to rest. This eliminates the need for the very costly brake mechanism on the machine. Other examples are dry cleaning equipment, where it is important not to gain entry to the machine until all hazardous vapours have been evacuated. It is, therefore, apparent that the lock may be controlled by a device which will only release the catch of the latch when the above type of of cycle in cleaning clothes has been completed.

With the handle, barrier and catch of this invention and their relationship to the door and housing of the machine, one is not able to grasp the handle while the catch is secured by the locking means due to the obstacle provided by the barrier. It is, therefore, apparent that this type of closure provides the added safety feature in not presenting a handle for the door thereby to gain access during, for example, a hazardous portion of the clothes treating cycle. This type of closure provides the only form of access to opening the door, since the remaining part of the door is free of any other items which would provide a handhold for manually opening the door.

Various types of clothes cleaning devices have been discussed with regard to the closure of this invention. It is appreciated that a particular advantageous use of this closure is on coin operated machines in laundromats. This type of machine is usually subjected to a fair amount of abuse and is not always used with the proper amount of caution. Therefore, this type of closure system enhances the safety aspects of coin operated washing machines, because it further reduces the likelihood of someone being injured during the hazardous spin cycle of a top loading machine. The closure is also useful on coin operated front loading machines with respect to the spin cycle and also during the washing cycle to preclude people opening the front door during this cycle which could result in embarrassing spills.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In an appliance for cleaning and treating clothes having a housing, a door and a closure for said door, said closure comprises means for impeding access to a handle portion for said door, a catch means for releasably securing said door shut and means for locking said catch means, said impediment means being manually movable to gain access to said handle where such movement release said catch when unlocked, the arrangement being such that when said catch means is locked, movement of said impediment means to gain effective handle access is prevented, said locking means having a time delay release for locking said catch to thereby preclude access to said handle.

2. In an appliance of claim 1, said impediment means being manually slidable relative to said door to expose said handle portion for gaining effective handle access.

3. In an appliance of claim 2, means for biasing said impediment means towards a position which impedes handle access.

4. In an appliance of claim 3, said catch means being associated with said impediment means, said catch means securing said door shut when said impediment means is in said biased position to impede handle access and said catch means when locked prevents movement of said impediment means.

5. In an appliance of claim 4, said catch means being secured to said impediment means.

6. In an appliance of claim 1, said impediment means being movably mounted on said door for impeding access to said handle portion, said impediment means being manually movable in a direction which places an operator's fingers beneath said handle portion in gaining handle access to facilitate opening said door with one hand.

7. In an appliance of claim 6, said impediment means being slidably mounted on said door, said handle portion being provided on said door and adapted to overlie said impediment means, said impediment means being manually slid beneath said handle portion to gain handle access.

8. In an appliance of claim 7, the door surface having a depression to define entrance to a handle portion on the underside of the door surface and thus provide a door handle in the general plane of said door, said impediment means being located at said entrance to impede handle access and being manually slidable away from said entrance beneath said handle portion to gain handle access.

9. In an appliance of claim 8, means for resiliently biasing said impediment means to said entrance.

10. In an appliance of claim 8, said catch being provided on said impediment means to release the unlocked catch when said impediment means is slid to gain handle access.

11. In an appliance of claim 1, said door having an opening in which said impediment means is mounted for slidable movement, said handle portion overlying said impediment means which in a first position impedes handle access and means for resiliently urging said impediment means to said first position, said impediment means being adapted to permit manual one-handed sliding thereof beneath said handle portion a sufficient extent to a second position to place an operator's fingers beneath said handle portion for opening said door, such extent of slide movement of said impediment means to said second position releasing said catch when unlocked.

12. In an appliance of claim 11, having said door provided on the top of said housing, a depression provided in said door in which said opening is defined for said impediment means so as to be mounted below the door surface, said handle being generally in the plane of said door surface to provide a flush top appliance.

13. In an appliance of claim 12, said door being hingedly secured at its rear to said housing and said handle portion being located proximate the front of said door to facilitate one-handed opening of said door whereby said impediment means is slid towards door front in gaining handle access.

14. In an appliance of claim 11, said impediment means comprising a body portion which a finger recess is provided, said body portion including means adapting its slide mounting in said opening, a wall of said recess impeding handle access, said wall being pushed beneath said handle portion by an operator's fingers to gain handle access.

15. In an appliance of claim 14, said catch being provided on said body portion and depending therefrom to be engaged by said locking means mounted on said housing.

16. In an appliance of claim 15, said catch being of material dissimilar from said body portion and being removably secured to the underside of said body portion.

17. In an appliance of claim 16, a spring means associated with said body portion for resiliently urging said upright wall of said finger recess into alignment with said handle outer edge and thereby positioning said catch for engagement by said locking means.

18. In an appliance of claim 12, said locking means being provided with a time delay release.

19. In an appliance of claims 2 or 18, said appliance being adapted to wash clothes, wherein a spin cycle is used to centrifuge such clothes, a drum in which such clothes are contained being free to cease rotation on its own after completion of the spin cycle, the period of time delay being greater than the predetermined period of time needed for such drum to cease rotation.

* * * * *